US011266225B2

(12) United States Patent
Wagner et al.

(10) Patent No.: US 11,266,225 B2
(45) Date of Patent: Mar. 8, 2022

(54) LANYARD CLIP

(71) Applicant: Milwaukee Electric Tool Corporation, Brookfield, WI (US)

(72) Inventors: Andrew G. Wagner, Lisbon, WI (US); Trent T. Bauters, West Allis, WI (US); Caleb C. Adams, Wauwatosa, WI (US); George Barton, Mequon, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 0 days.

(21) Appl. No.: 16/718,510

(22) Filed: Dec. 18, 2019

(65) Prior Publication Data

US 2020/0187631 A1 Jun. 18, 2020

Related U.S. Application Data

(63) Continuation of application No. PCT/US2019/066339, filed on Dec. 13, 2019.
(Continued)

(51) Int. Cl.

| | |
|---|---|
| ***A45F 5/02*** | (2006.01) |
| ***A42B 3/04*** | (2006.01) |
| *A45F 5/00* | (2006.01) |

(52) U.S. Cl.
CPC ..... *A45F 5/02* (2013.01); *A42B 3/0406* (2013.01); *A45F 2005/006* (2013.01);
(Continued)

(58) Field of Classification Search
CPC ..... Y10T 24/44521; Y10T 24/44718; Y10T 24/44709; Y10T 24/44692;
(Continued)

(56) References Cited

U.S. PATENT DOCUMENTS 768,767 A * 8/1904 Mensor et al. ..... A41F 3/02 24/504
995,298 A * 6/1911 Sims ..... A41F 11/02 24/516
(Continued)

FOREIGN PATENT DOCUMENTS

CN 2309731 3/1999
CN 207856105 9/2018
(Continued)

OTHER PUBLICATIONS

International Search Report and Written Opinion for PCT/US2019/066339, dated Apr. 8, 2020, 11 pages.

*Primary Examiner* — Robert Sandy
*Assistant Examiner* — Michael S Lee
(74) *Attorney, Agent, or Firm* — Reinhart Boerner Van Deuren s.c.

(57) ABSTRACT

The present disclosure describes clips for lanyards, such as hard hat lanyards. The clips include opposing teeth that move to a closed/clamped position to secure a lanyard to a user, such as to the clothes of a user. The clip includes a body, a lever and a grip. Opposing teeth are located on the grip and body. The clip includes multiple pivoting connections between the body, lever and grip. The teeth on the grip may lie along an arcuate path and/or may have a tooth depth that facilitates engagement with material such as clothing.

19 Claims, 12 Drawing Sheets

Related U.S. Application Data

(60) Provisional application No. 62/779,300, filed on Dec. 13, 2018.

(52) U.S. Cl.
CPC .... *Y10T 24/44368* (2015.01); *Y10T 24/44419* (2015.01); *Y10T 24/44444* (2015.01); *Y10T 24/44521* (2015.01)

(58) Field of Classification Search
CPC ..... Y10T 24/44462; Y10T 24/44444; Y10T 24/44419; Y10T 24/4441; Y10T 24/44402; Y10T 24/44385; Y10T 24/44376; Y10T 24/44368; Y10T 24/1397; Y10T 24/4435; Y10T 24/44342; Y10T 24/44291; Y10T 24/44274; Y10T 24/1391; Y10T 24/13; Y10T 24/203; Y10T 24/204
See application file for complete search history.

(56) References Cited

U.S. PATENT DOCUMENTS

| | | | | |
|---|---|---|---|---|
| 1,815,006 | A * | 7/1931 | Horsting | C14B 1/26 24/498 |
| 3,165,059 | A | 1/1965 | Saunders | |
| 4,005,510 | A * | 2/1977 | Noda | A41F 3/02 24/504 |
| 6,059,213 | A | 5/2000 | Phillips | |
| 6,175,994 | B1 | 1/2001 | Nicoletti | |
| 6,179,238 | B1 | 1/2001 | Phillips | |
| 6,536,697 | B2 | 3/2003 | Tsan | |
| 7,374,123 | B2 | 5/2008 | Han | |
| 7,424,997 | B2 | 9/2008 | Achtari et al. | |
| 7,458,488 | B2 | 12/2008 | Bass et al. | |
| 7,810,220 | B2 | 10/2010 | Anthony et al. | |
| 7,857,099 | B2 | 12/2010 | Choate | |
| 8,342,575 | B2 * | 1/2013 | Coleman | F16B 2/185 280/818 |
| 8,746,519 | B2 | 6/2014 | Young et al. | |
| 9,169,972 | B2 | 10/2015 | Hesl et al. | |
| 9,242,128 | B2 | 1/2016 | Macy | |
| 2001/0049863 | A1 * | 12/2001 | Ogino | A44B 99/00 24/265 EC |
| 2005/0045676 | A1 | 3/2005 | Bass et al. | |
| 2006/0283081 | A1 | 12/2006 | Killen | |
| 2008/0105779 | A1 | 5/2008 | Han | |
| 2009/0084697 | A1 | 4/2009 | Gross | |
| 2009/0242595 | A1 | 10/2009 | Gross | |
| 2010/0116922 | A1 | 5/2010 | Choate et al. | |
| 2010/0206922 | A1 | 8/2010 | Gross et al. | |
| 2015/0157116 | A1 | 6/2015 | Williams | |
| 2016/0143426 | A1 * | 5/2016 | Bazan | A45F 5/021 224/271 |
| 2019/0091495 | A1 | 3/2019 | Zwart | |

FOREIGN PATENT DOCUMENTS

| | | |
|---|---|---|
| DE | 1938245 | 5/1966 |
| DE | 3323716 | 5/1984 |
| DE | 29903185 | 5/1999 |
| EP | 0193253 | 9/1989 |
| JP | 02-021507 | 6/1990 |
| WO | WO07116202 | 10/2007 |
| WO | WO10081202 | 7/2010 |
| WO | WO 2018-039153 | 3/2018 |
| WO | WO18140356 | 8/2018 |

* cited by examiner

LANYARD CLIP

CROSS-REFERENCE TO RELATED PATENT APPLICATION

The present application is a continuation of International Application No. PCT/US2019/066339, filed Dec. 13, 2019, which claims the benefit of and priority to U.S. Provisional Application No. 62/779,300, filed on Dec. 13, 2018, which are incorporated herein by reference in their entireties.

BACKGROUND OF THE INVENTION

The present disclosure relates generally to the field of lanyard clips, and more specifically to lanyards clips for connecting various equipment, such as construction equipment, tools, safety equipment, etc. to clothing of a user. In particular embodiments, the lanyard clips discussed herein are used to connect a hard hat to the clothing of a worker wearing a hard hat. Hard hats are protective gear designed to absorb the force from objects that would have otherwise struck the head of the person wearing the hard hat. Among other uses, hard hats are commonly worn in the construction industry.

In some situations, such as when a construction worker is working high above the ground on a frame of a building, if the hard hat falls off the worker's head then the worker is left without adequate protection for his/her head. Hard hat lanyards with clips help users avoid losing their hard hats when the hard hat falls off the user's head by coupling the hard hat to the user's clothing. Hard hat lanyards typically include a loop to attach to the hard hat and a clip to attach to an article of the user's clothing (e.g., shirt collar, t-shirt, undershirt, coat pocket, coat collar, fall protection harness, straps, belt, etc.).

SUMMARY OF THE INVENTION

In various embodiments, the present disclosure describes a lanyard clip used for coupling equipment such as tools, safety equipment, etc. to a user. In specific embodiments, the present disclosure describes various embodiments using a lanyard to couple a hard hat to a worker. At one end of the lanyard is an attachment component, such as a loop with a fastener, that couples to the user's equipment, such as to the hard hat. At the other end of the lanyard is a clip that couples the lanyard to the worker, such as to clothing worn by the worker. The disclosure describes clips with gripping structures that work with various clothing materials having a range of thicknesses and properties (e.g., a relatively slippery surface, a low factor of compressibility).

In one embodiment, the lanyard system, such as a hard hat lanyard device, comprises a flexible lanyard. One end of the lanyard comprises a coupling component, such as a hard hat coupling component, engageable with equipment, such as a hard hat, and the other end of the lanyard comprises a clip configured to detachably couple with clothing. The clip comprises two arms extending from the clip body that define an opening. First teeth project from the first arm towards the second arm. The clip further comprises a lever that is pivotally coupled to the second arm and is pivotally coupled to an engaging component comprising second teeth that engage the first teeth. The engaging component, in addition to being pivotally coupled to the lever, is also pivotally coupled to the clip body. The clip further comprises a spring that biases a first end of the lever away from the clip body, thus biasing the second end of the lever, which is coupled to the engaging component, towards the first teeth. As a result, the spring biases the second teeth of the engaging component towards the first teeth. The first and second teeth comprise several rows of teeth that are angled towards an interior of the clip opening. The second teeth are disposed along a curved outer surface of the engaging component. The second teeth comprise several columns of teeth that are arranged in a staggered format with respect to each other.

In another embodiment, the lanyard system, such as a hard hat lanyard device, comprises a flexible lanyard. One end of the lanyard comprises a coupling component, such as a hard hat coupling component, engageable with equipment, such as a hard hat, and the other end of the lanyard comprises a clip configured to detachably couple with clothing. The clip comprises two arms extending from the clip body that define an opening. First teeth project from the first arm towards the second arm. The clip further comprises a lever that is slidably coupled to the clip body. The lever is pivotally coupled to an engaging component comprising second teeth that engage the first teeth. The engaging component is also pivotally coupled to the second arm. The clip further comprises a spring that biases the lever away from the engaging component, thus biasing the engaging component to rotate the second teeth towards the first teeth. As the lever is slid towards the engaging component against the spring's bias, the second teeth of the engaging component are moved away from the first teeth. The first and second teeth comprise several rows of teeth that are angled towards an interior of the clip opening. The second teeth are disposed along a curved outer surface of the rotating component. The second teeth comprise several columns of teeth that are arranged in a staggered format with respect to each other.

In another embodiment, the lanyard system, such as a hard hat lanyard device, comprises a flexible lanyard. One end of the lanyard comprises a coupling component, such as hard hat coupling component, engageable with equipment, such as a hard hat, and the other end of the lanyard comprises a clip configured to detachably couple with clothing. The clip comprises two arms defining an opening. First teeth project inwardly from the first arm towards the second arm. The clip further comprises a button that is slidably coupled to the second arm, the button being rigidly coupled to the second teeth engageable with the first teeth. As the button moves towards the end of the second arm, the second teeth move towards the first teeth. The clip further comprises a spring that biases the button towards the end of the second arm, thus biasing the second teeth towards the first teeth. As the button is slid against the spring's bias, the second teeth are moved away from the first teeth. The first and second teeth are arranged along parallel surfaces and comprise several rows of teeth that are angled towards an interior of the clip opening.

In another embodiment, the lanyard device, such as a hard hat lanyard system, comprises a flexible lanyard. One end of the lanyard comprises a coupling component, such as a hard hat coupling component, engageable with equipment, such as a hard hat, and the other end of the lanyard comprises a clip configured to detachably couple with clothing. The clip comprises two arms defining an opening. A ramp projects from an end of the first arm towards an end of the second arm. The clip comprises an engaging component rotatably coupled to the second arm, the engaging component comprising thumb grips and second teeth that engage the first teeth. The engaging component is rotatably coupled to the second arm at a pivot location that is different than a center of the engaging component. The second teeth and the thumb grips project radially outward from a center of the engaging component. The engaging component is configured to be rotated in a first direction until the thumb grips interface against the first arm, preventing further rotation of the engaging component in the first direction.

Another embodiment relates to a lanyard clip including a body, a lever pivotally coupled to the body, a grip pivotally coupled to the lever, a first plurality of teeth that extend from the grip towards the body, and a second plurality of teeth that extend from the body towards the grip. The lever pivots with respect to the body about a first axis. The grip pivots with respect to the lever about a second axis. The grip is also pivotally coupled to the body and the grip pivots with respect to the body about a third axis. The first axis, the second axis, and the third axis are spaced apart from each other. The grip is moveable about the second and third axes between an open position and a clamped position. In the clamped position, the second plurality of teeth interface against the first plurality of teeth.

Another embodiment relates to a lanyard clip includes a body, grip pivotally coupled to the body, a first plurality of teeth, and a second plurality of teeth that extend from the body towards the first plurality of teeth. Each of the first plurality of teeth includes a tip. The first plurality of teeth extend from the grip in an orientation such that the tips of the first plurality of teeth lie on an arcuate path. The second plurality of teeth interface against the first plurality of teeth when the lanyard clip is in a closed position.

Another embodiment relates to a lanyard clip including a body, a grip pivotally coupled to the body, a first plurality of teeth extending from the grip towards the body, and a second plurality of teeth extending from the body towards the grip. The grip is moveable relative to the body between an open position and a clamped position. In the clamped position, the second plurality of teeth interface against the first plurality of teeth. The first plurality of teeth have a tooth depth between 0.12 inches and 0.18 inches. The second plurality of teeth have a tooth depth between 0.12 inches and 0.18 inches.

Additional features and advantages will be set forth in the detailed description which follows, and, in part, will be readily apparent to those skilled in the art from the description or recognized by practicing the embodiments as described in the written description included, as well as the appended drawings. It is to be understood that both the foregoing general description and the following detailed description are exemplary.

The accompanying drawings are included to provide further understanding and are incorporated in and constitute a part of this specification. The drawings illustrate one or more embodiments and, together with the description, serve to explain principles and operation of the various embodiments.

DETAILED DESCRIPTION

Figure 1:
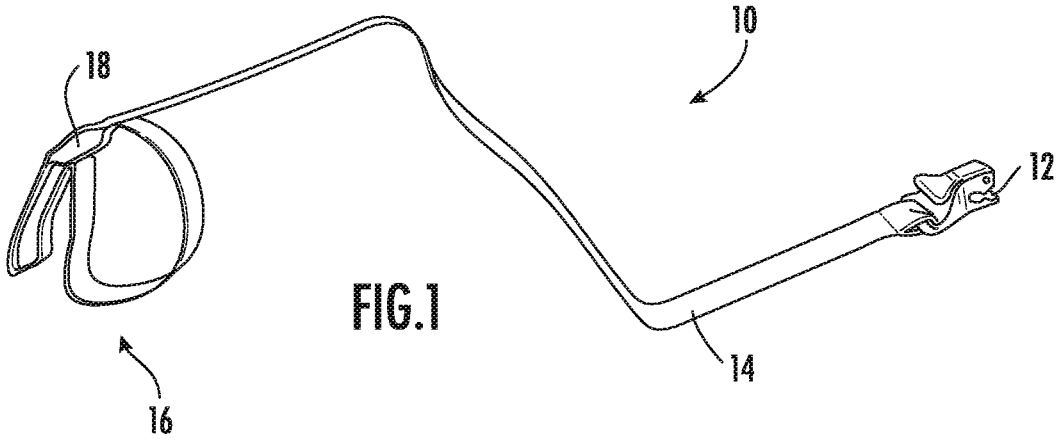
FIGS. 1-4 show a standard prior art hard hat lanyard.
Figure 2:
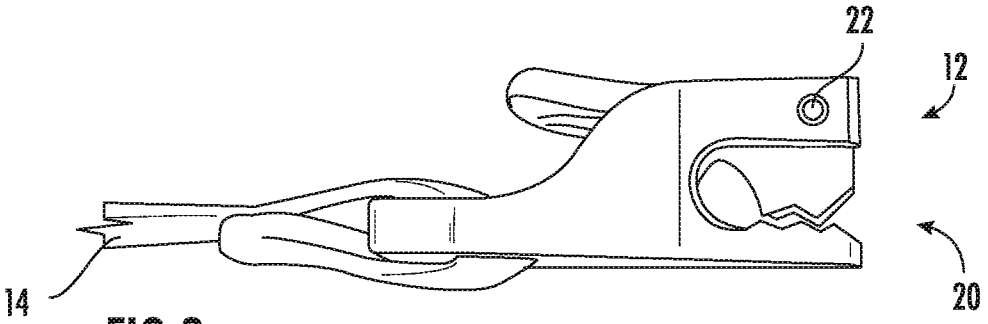
Figure 3:
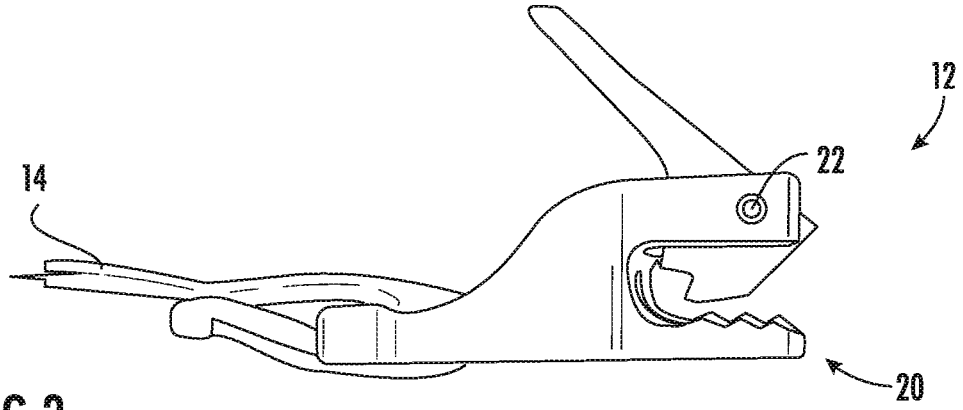
Figure 4:
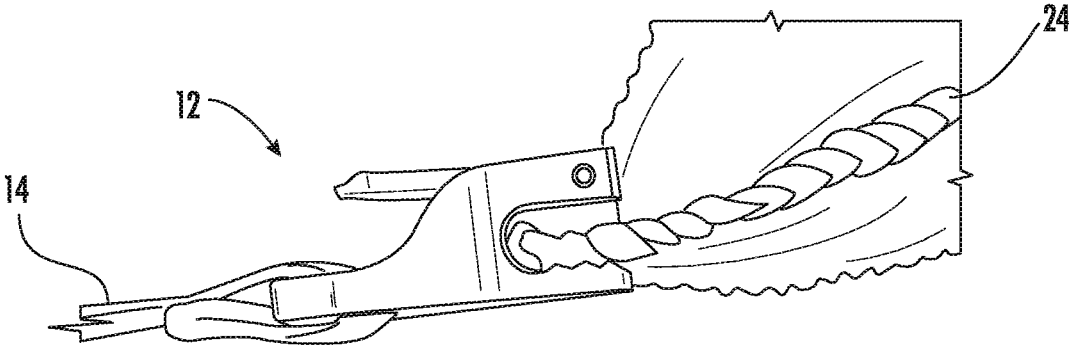

Referring generally to the figures, various embodiments of a lanyard system, such as a hard hat lanyard, are shown. Various embodiments of the hard hat lanyard discussed herein include clips of various designs configured to remain coupled to clothing on a worker even when a force (e.g., the force of a falling hard hard) pulls the clip away from the clothing.

Referring to FIGS. 1-4, prior art lanyard system 10 having a standard, prior art clip 12 is shown. In general, a lanyard system includes clip 12 connected to a lanyard 14 with an attachment loop 16. Attachment loop 16 is threaded through a hole in a hard hat and is secured via the loop fastener 18. Clip 12 includes a jaw 20 having a single pivot 22 for clamping/griping a user's clothes 24 between opposing sets of teeth within jaw 20. As will be discussed in more detail below, the clip designs of the present application are believed to provide for improved usability and gripping as compared to the prior art clip designs, such as clip 12, via the various features (e.g., multiple pivot axes, shape/positioning of gripping teeth, tooth depth, etc.) discussed herein.

Referring to FIGS. 5A-15, a lanyard system, such as lanyard system 50, is shown according to an exemplary embodiment. In general, lanyard system 50 includes a clip, shown as lanyard clip 52, coupled at a first end of lanyard 54. Located at a second end of lanyard 54 is an attachment device, shown as loop attachment 56. In general, clip 52 is configured to be coupled to a user/worker, such as by engaging a user's clothes, and loop attachment 56 is configured to be connected to equipment, such as a tool or safety equipment, such as a hard hat, etc. In one specific embodiment, lanyard system 50 is a hard hat lanyard system used to secure a user's hard hat to his or her clothing. In this embodiment, attachment loop 56 is threaded through a hole in the hard hat and is secured via loop fastener 58. As shown, lanyard 54 couples attachment loop 56 to clip 52. In various embodiments, lanyard 54 is an elastic material that is configured to absorb energy if the hard hat falls off of the user's head. Clip 52 is used to attach the lanyard to the user's clothes.

Figure 5A:
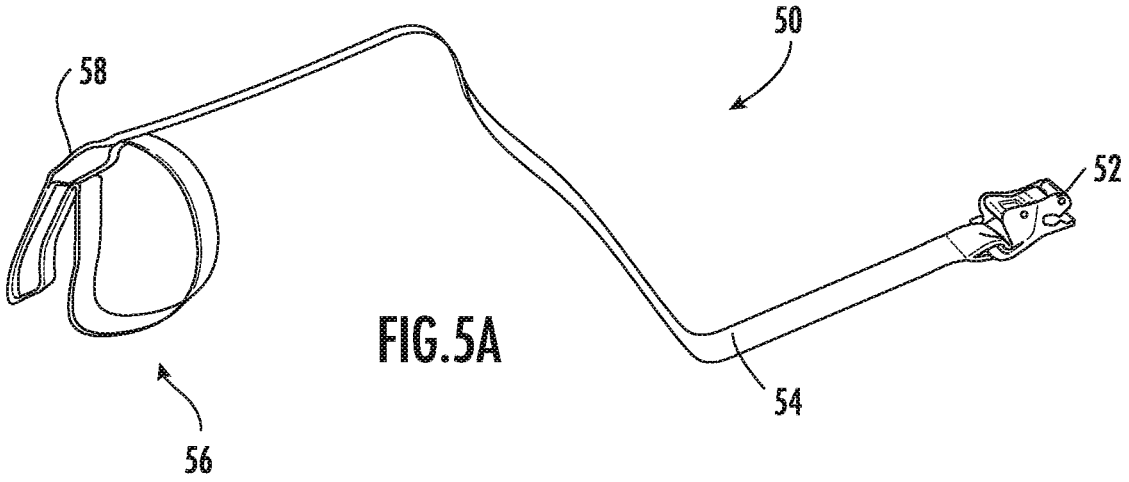
FIG. 5A is a perspective view of a lanyard system, according to an exemplary embodiment.
Figure 5B:
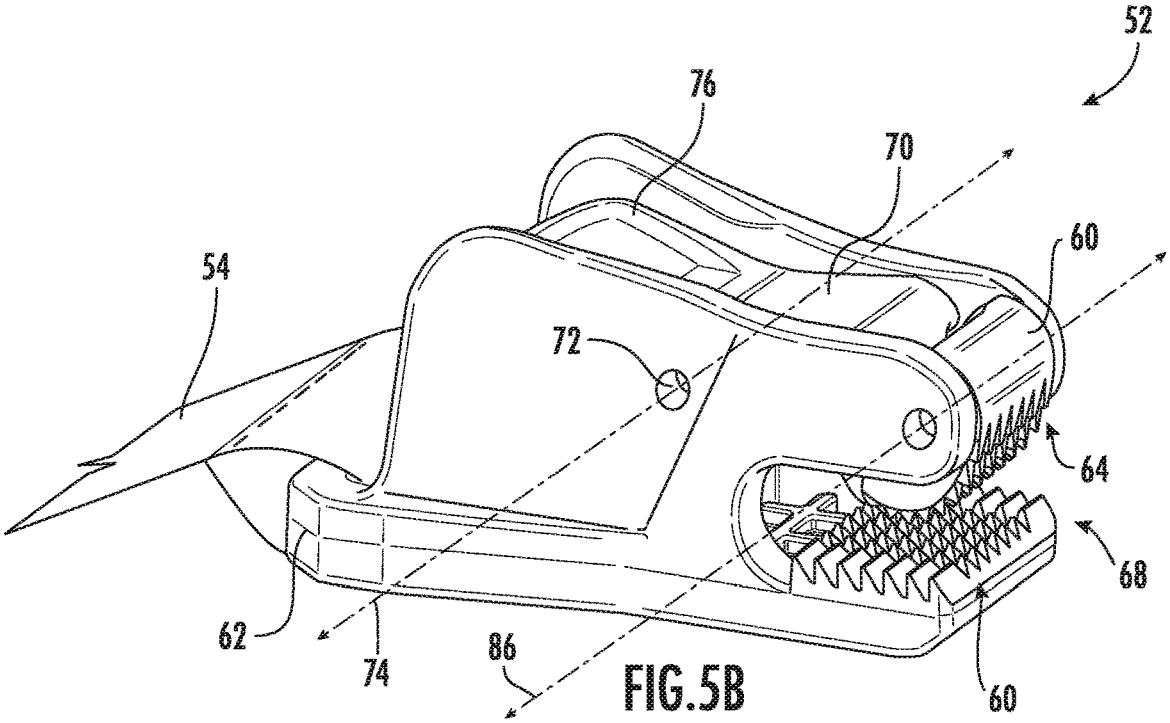
FIG. 5B is a detailed view of a lanyard clip of the lanyard system of FIG. 5A, according to an exemplary embodiment.

Referring to FIG. 5B, clip 52 includes a grip 60 and a body 62. Clip 52 includes teeth, shown as gripping teeth 64, that extend away from grip 60 toward body 62 and teeth, shown as gripping teeth 66, that extend from body 62 toward grip 60. In the specific design and orientation shown in FIG. 5B, gripping teeth 64 generally extend downward toward gripping teeth 66. In this manner, gripping teeth 64 define a top surface of a grip or clamping area 68 and gripping teeth 66 define a bottom surface of the grip or clamping area 68.

In general, the top surface defined by upper gripping teeth 64 is coupled to rotate about a pivot when the user lifts or lowers a lever associated with clip 52. The C-shaped body 62 locates the pivot and the lower gripping teeth such that upper teeth 64 and lower teeth 66 are aligned and engage when clip 52 is moved from the open position (shown in FIG. 5B) to the clamped or closed position (shown in FIG. 7). In some embodiments, the C-shape of body 62 allows the body to deform slightly to accommodate larger materials and provide a gripping spring force that clamps the user's clothes.

As discussed herein, Applicant believes that the clip designs discussed herein work particularly well for engaging a wide variety of clothes material. For example, when the user's hard hat falls off of his or her head, a pulling force is applied between the user's clothes (e.g., the cloth shown) and the clip. In some situations, if the user's clothing material is too thin, there may not be enough gripping force between the gripping teeth of the clip to overcome the pulling force when the user's hard hat falls off. That is, if the user's shirt material is too thin, the hard hat lanyard fails. Similarly, if the user's clothes are too thick, some lanyard clips cannot fit the user's clothes into the clip and, therefore, cannot be secured to the user's clothes. Also, the material properties of the user's clothes may affect the pulling force the clip may sustain before the clothes are pulled out. For example, knit cotton has different frictional and compressive properties than wool, polyester, flame retardant material, etc. Accordingly, the clip designs discussed herein provide gripping compatible with a wide variety of clothing materials.

Specifically, in various embodiments, the clip designs described herein provide sufficient grip force for a variety of materials and a variety of material thicknesses to provide a functional hard hat lanyard. In various embodiments, the clip designs discussed herein are configured such that as the clothing material is pulled out of the clip, the teeth grip and tighten their grip on the material. For example, the clip designs shown in FIGS. 5A-28 are configured to accommodate and provide sufficient gripping force with clothing material that is, for exemplary purposes only and without limitation, 0-4 mm thick and can provide 100 lbs. or more of peak pulling force before the clip disengages. In contrast, Applicant believes that standard clip designs, such as the one shown in FIGS. 1-4 may fail at 30 lbs or less of pulling force. In addition, in some embodiments, the teeth of the clip designs discussed herein, such as gripping teeth 64 and 66, are arranged to be angled inward to increase the grip of the clip on the clothes material (as opposed to teeth that are perpendicular to the pulling force).

Figure 6:
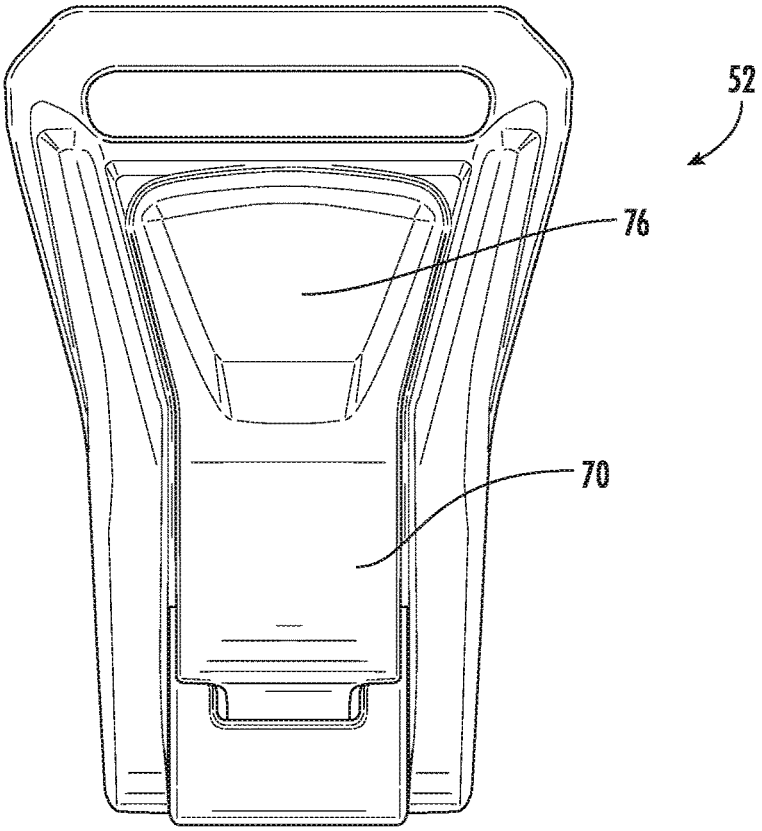
FIG. 6 is a top plan view of the lanyard clip of FIG. 5B, according to an exemplary embodiment.

Referring to FIGS. 5B-15, details of the design of clip 52 that Applicant believes provide for improved functionality, including improved gripping force and adaptability to grip a wide range of clothing materials, is shown and described. Clip 52 includes lever 70. Lever 70 is pivotally coupled to body 62 via a first pivot connection 72 that defines a first pivot axis 74. In general, a user pushes down on lever handle 76 to cause lever 70 to pivot about axis 74 and move clip 52 to the open position shown in FIG. 5B. FIG. 6 shows a top view of clip 52 showing lever 70. As shown in FIG. 6, lever handle 76 has a tapered shape and a recess that facilitates user actuation of lever 70.

Figure 7:
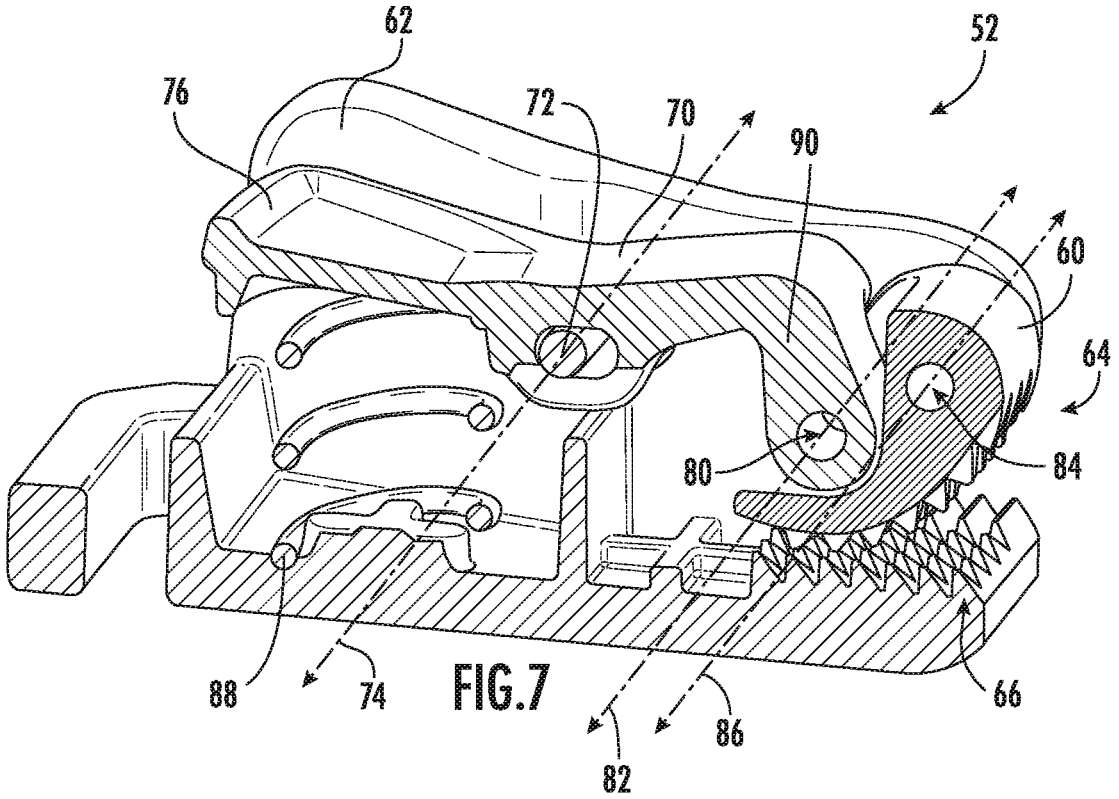
FIG. 7 is a sectional perspective view of a lanyard clip of FIG. 5B, according to an exemplary embodiment.

Referring to FIGS. 5B and 7, details of the operation of grip 60 and lever 70 are shown in more detail. Clip 52 includes a second pivot connection 80 that pivotally couples grip 60 to lever 70 such that grip 60 pivots with respect to lever 70 about a second pivot axis 82. Clip 52 includes a third pivot connection 84 that pivotally couples grip 60 to body 62 such that grip 60 also pivots with respect to body 62 about a third pivot axis 86. In general, as lever 70 is actuated to move about pivot axis 74, grip 60 is moveable about axes 82 and 86 to an open position (shown in FIG. 5B) in which gripping teeth 64 are spaced from gripping teeth 66 to allow for insertion of material, clothing, etc. into clamping area 68. Grip 60 is also moveable in the opposite direction about axes 82 and 86 to a closed position (shown in FIG. 7) in which gripping teeth 64 are brought into engagement or overlap with gripping teeth 66 such that material, clothing, etc. will be clamped between teeth 64 and 66 in the closed position.

Clip 52 includes a biasing element, shown as spring 88. In general, spring 88 is biased to hold clip 52 in the closed position until a user applies force to handle 76 of lever 70. In the orientation of FIG. 7, spring 88 is biased to provide an upward force on the lower surface of lever 70 below handle 76. This provides for clockwise rotation of lever 70 about pivot connection 72. Under clockwise rotation, grip engagement end 90 of lever 70 moves grip 60 about axes 82 and 86 such that grip teeth 64 are brought into engagement with grip teeth 66 such that clip 52 assumes the closed/clamped position.

When a user presses downward on handle 76, spring 88 is compressed, and lever 70 rotates about pivot connection 72 in the counterclockwise direction. Under counterclockwise rotation of lever 70, grip 60 pivots about axes 82 and 86 such that grip teeth 64 are moved away from grip teeth 66 such that clip 52 assumes the open position.

The movement of lever 70 and grip 60 is the result of the locations of the pivot axes as shown in FIG. 7. In the length direction (e.g., in the direction between the lanyard end and clamp end) of clip 52, pivot axis 82 is located between pivot axes 74 and 86, and pivot axis 74 is located between spring 88 and pivot axis 82. In the height direction (e.g., in the direction perpendicular to teeth 66) of clip 52, the vertical distance between pivot axis 82 and teeth 66 is less than the vertical distance between pivot axis 86 and teeth 66. Further, in this arrangement both pivot axes 82 and 86 are located above teeth 66.

Figure 8:
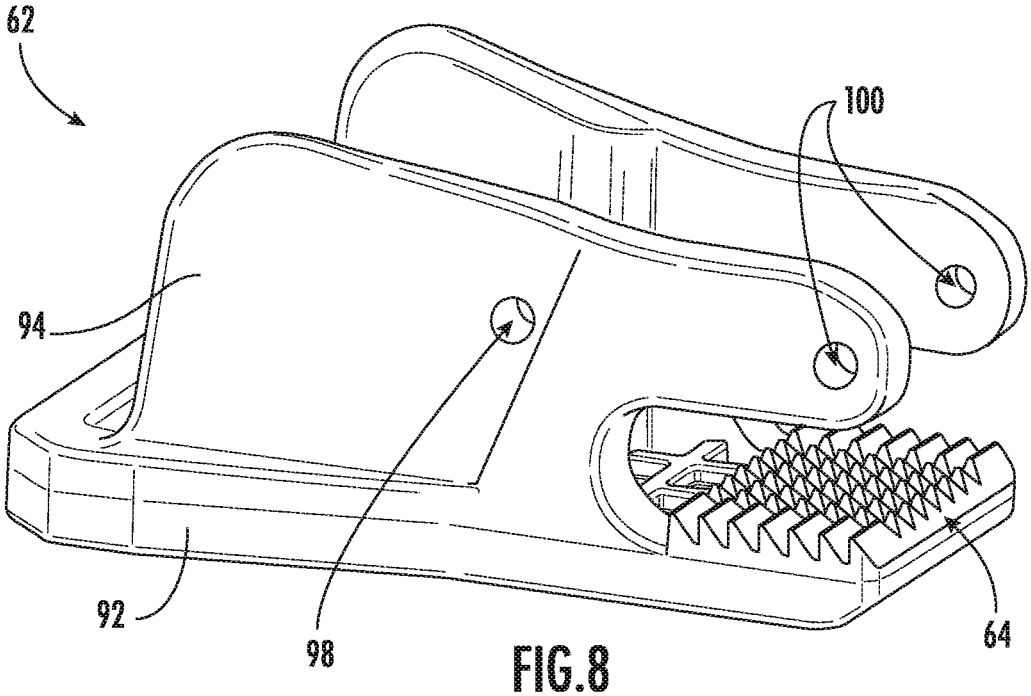
FIG. 8 is a side perspective view of a clip body of the lanyard clip of FIG. 5B, according to an exemplary embodiment.
Figure 9:
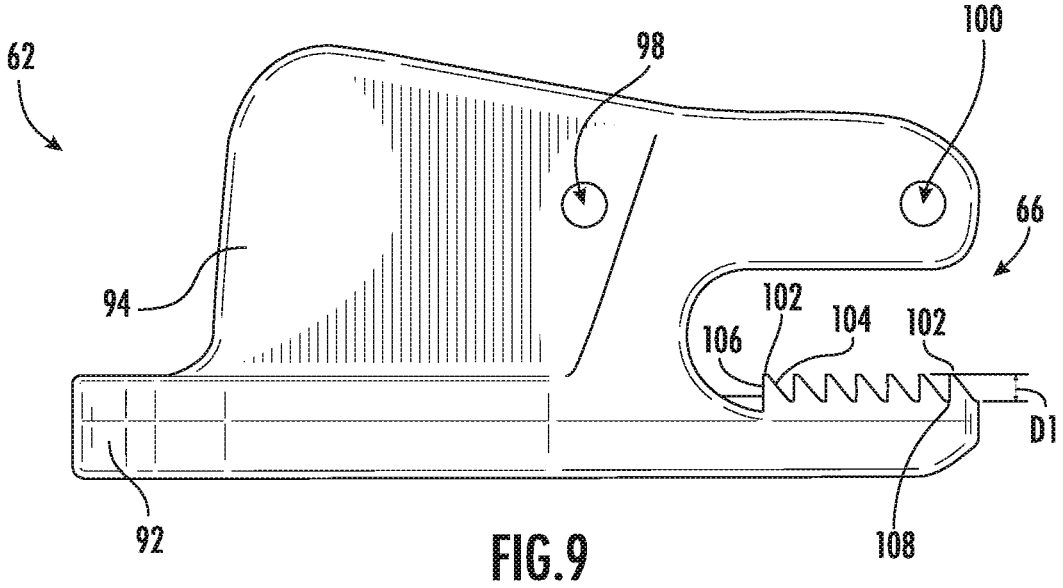
FIG. 9 is a side view of a clip body of the lanyard clip of FIG. 5B, according to an exemplary embodiment.
Figure 10:
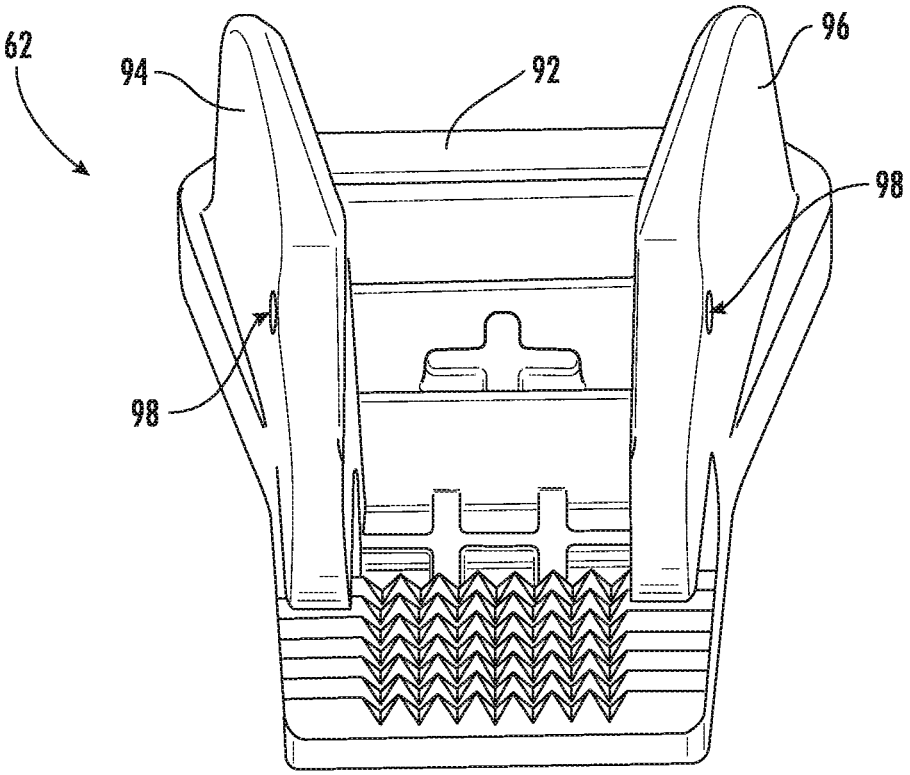
FIG. 10 is a front perspective view of a clip body of the lanyard clip of FIG. 5B, according to an exemplary embodiment.

Referring to FIGS. 8-10, views of body 62 with grip 60 and lever 70 removed are shown. Body 62 includes a base wall 92, a first sidewall 94 and a second sidewall 96, and sidewalls 94 and 96 extend way from and are substantially perpendicular to base wall 92. A first pair of openings 98 are defined in sidewalls 94 and 96 and receive pivot connection 72 (shown in FIG. 7). A second pair of openings 100 are defined in sidewalls 94 and 96 and receive pivot connection 84 (shown in FIG. 7).

Referring to FIG. 9, details of the gripping teeth 66 of body 62 are shown. As shown in FIG. 9, each gripping tooth 66 includes a tip 102, a leading edge 104 and a trailing edge 106. In the embodiment shown in FIG. 9, leading edge 104 is at a non-parallel, non-perpendicular angle relative to a vertical axis and relative to trailing edge 106. Further, teeth 66 are shaped such that tips 102 lie in a substantially horizontal plane (e.g., such that a horizontal plane intersects at least three tips 102 of teeth 66, or such that the plane that intersects at least three tips 102 of teeth 66 is at an angle of plus or minus 10 degrees relative to horizontal).

Still referring to FIG. 9, teeth 66 define a tooth depth, D1. In the orientation of FIG. 9, D1 is the vertical distance between tips 102 and the lowest point 108 between adjacent teeth 66. In various embodiments, D1 is between 0.05 inches and 0.5 inches, and more specifically between 0.1 inches and 0.3 inches, and more specifically between 0.12 inches and 0.18 inches, and more specifically is 0.15 inches. Applicant has identified that this range of tooth depth alone or in combination with the depth of teeth 66 provides for improved gripping relative to a wide range of common clothing fabric types and thicknesses. In one embodiment, D1 represents the average depth of all teeth 66, and in another embodiment, D1 represents the maximum depth of all teeth 66.

Figure 11:
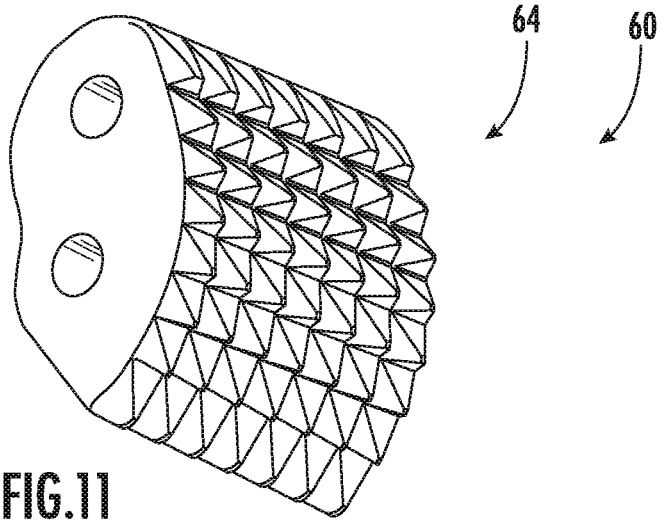
FIG. 11 is a bottom perspective view of a grip of the lanyard clip of FIG. 5B, according to an exemplary embodiment.
Figure 12:
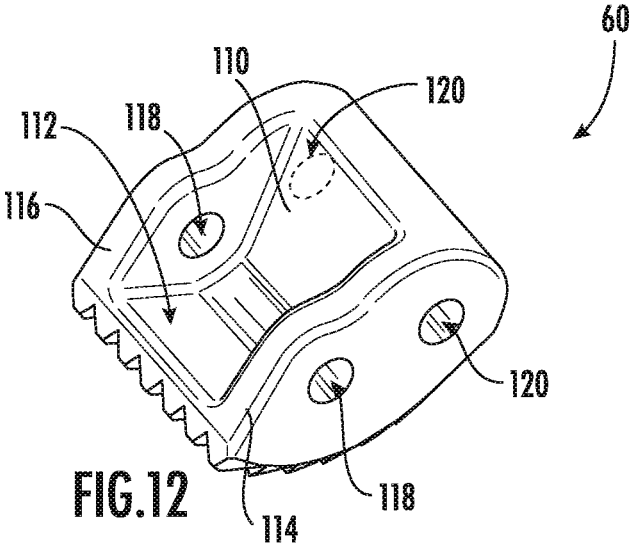
FIG. 12 is a top perspective view of a grip of the lanyard clip of FIG. 5B, according to an exemplary embodiment.
Figure 13:
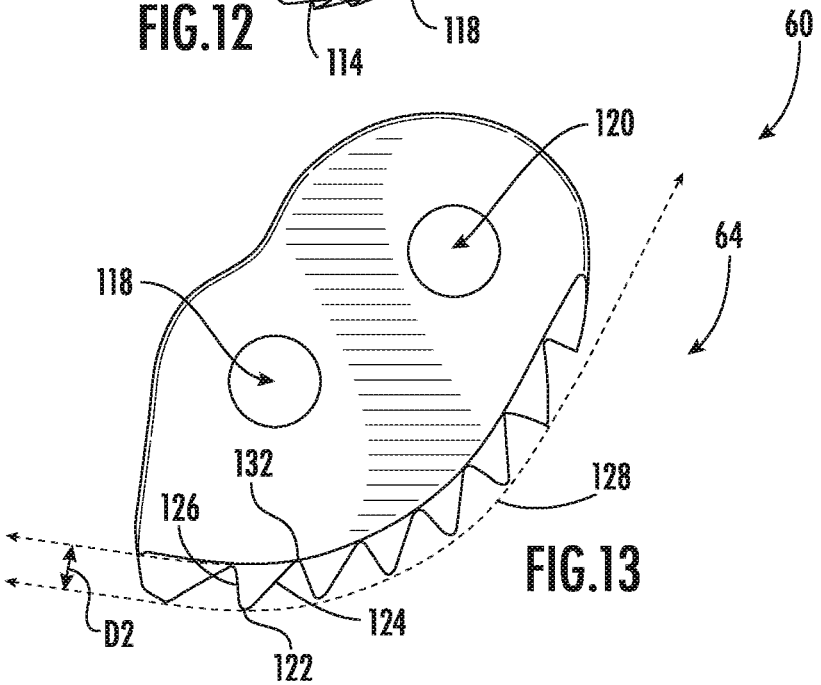
FIG. 13 is a side view of a grip of the lanyard clip of FIG. 5B, according to an exemplary embodiment.

Referring to FIGS. 11-13, detailed views of grip 60 are shown. Teeth 64 extend from grip 60 and generally define a portion of the perimeter surface of grip 60. Grip 60 includes a second or upper surface 110, generally opposite from teeth 64, that defines a recess 112. As shown best in FIG. 7, recess 112 receives grip engagement end 90 of lever 70.

Grip 60 includes a first sidewall 114 and a second sidewall 116. Grip 60 also includes a first pair of openings 118 defined with sidewalls 114 and 116 and an opening 120. Openings 118 receiving pivoting connection 80 (FIG. 7), and openings 120 receive pivoting connection 84 (FIG. 7). To form pivoting connection 84, openings 120 in grip 60 are aligned with openings 100 in body 62 and a pivoting connector such as a pin or shaft extends through openings 120 and 100 coupling body 62 to grip 60.

Referring to FIG. 13, details of the gripping teeth 64 of grip 60 are shown. As shown in FIG. 13, each gripping tooth 64 includes a tip 122, a leading edge 124 and a trailing edge 126. In the embodiment shown in FIG. 13, leading edge 124 is at a non-parallel, non-perpendicular angle relative to trailing edge 126. Further, grip 60 and teeth 64 are shaped such that tips 122 lie on an arcuate path 128.

Still referring to FIG. 13, teeth 64 define a tooth depth, D4. In the orientation of FIG. 13, D2 is the perpendicular distance between tips 122 and the lowest point 132 between adjacent teeth 66. In various embodiments, D2 is between 0.05 inches and 0.5 inches, and more specifically between 0.1 inches and 0.3 inches, and more specifically between 0.12 inches and 0.18 inches, and more specifically 0.15 inches. Applicant has identified that this range of tooth depth alone or in combination with the depth of teeth 64 provides for improved gripping relative to a wide range of common clothing fabric types and thicknesses. In one embodiment, D2 represents the average depth of all teeth 64, and in another embodiment, D2 represents the maximum depth of all teeth 66.

Figure 14:
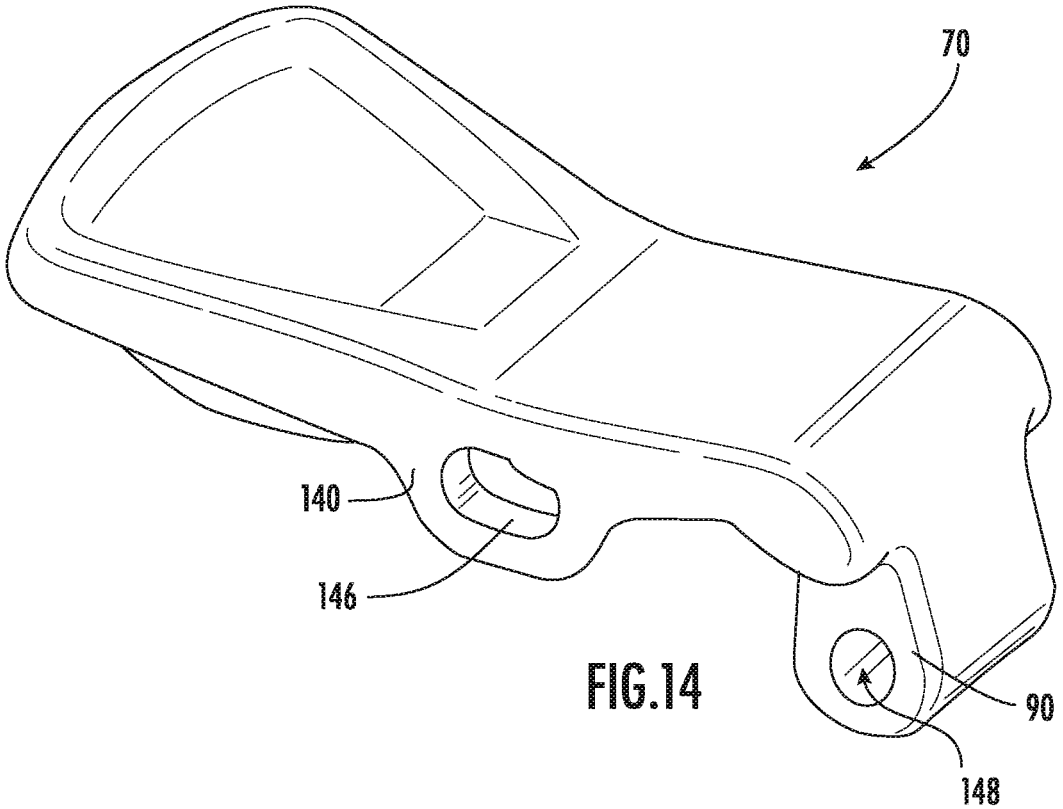
FIG. 14 is a top perspective view of a lever of the lanyard clip of FIG. 5B, according to an exemplary embodiment.
Figure 15:
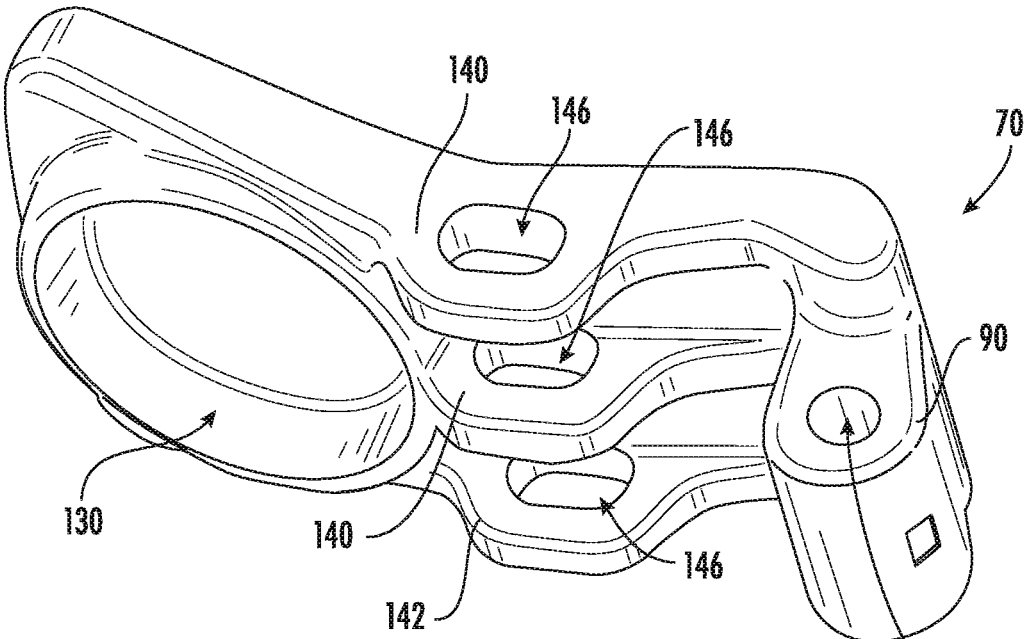
FIG. 15 is a top perspective view of a lever of the lanyard clip of FIG. 5B, according to an exemplary embodiment.

Referring to FIGS. 14 and 15, detailed views of lever 70 are shown. The lower surface of lever 70 includes a cavity or recess 130 defined within the body of lever 70 that receives or captures an upper end of spring 88. Recess 130 holds spring 88 in place relative to lever 70 during opening and closing of clip 52.

Referring to FIG. 15, lever 70 includes two sidewalls 140 and 142 and a central wall 144. A series of three aligned openings 146 are formed in each of sidewalls 140 and 142 and in central wall 144. Openings 146 receive pivoting connection 72 (FIG. 7). As will generally be understood, to form pivoting connection 72, openings 146 in lever 70 are aligned with openings 98 in body 62, and a pivoting connector such as a pin or shaft extends through openings 98 and 146 coupling lever 70 to body 62. As shown in FIG. 15, openings 146 are elongate in the length direction (e.g., are oval or elliptical shape). This shape allows for some translational movement of lever 70 relative to body 62, which in turn provides the desired movement of grip 60 during opening and closing of clip 52.

Referring to FIGS. 14 and 15, lever 70 includes an opening 148 formed in grip engagement end 90. Opening 148 receive pivoting connection 84 (FIG. 7). To form pivoting connection 84, opening 148 in lever 70 is aligned with opening 118 in grip 60, and a pivoting connector such as a pin or shaft extends through openings 148 and 118 coupling lever 70 to grip 60.

Figure 16:
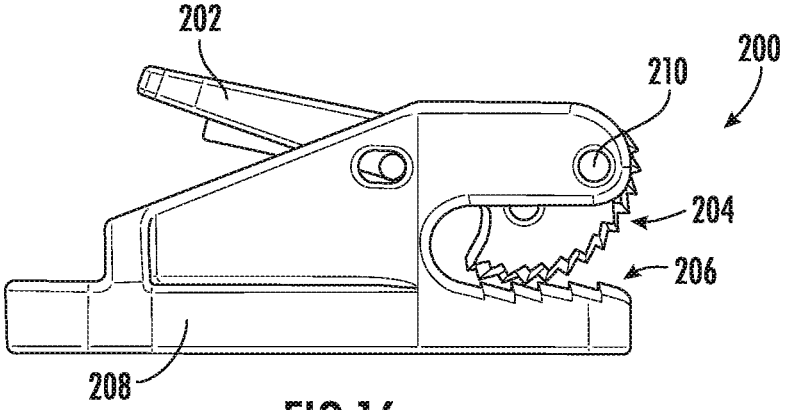
FIG. 16 is a side view of a hard hat lanyard clip, according to another exemplary embodiment.
Figure 17:
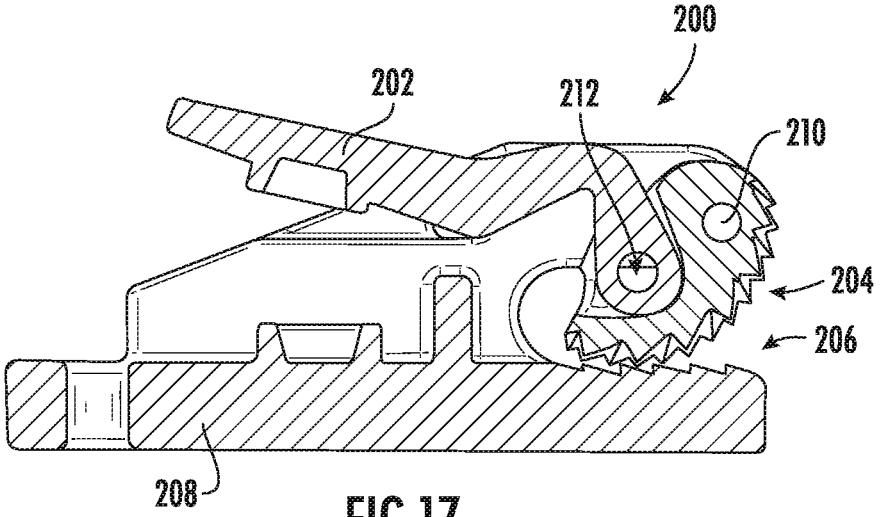
FIG. 17 is a sectional side view of the hard hat lanyard clip of FIG. 16, according to an exemplary embodiment.
Figure 18:
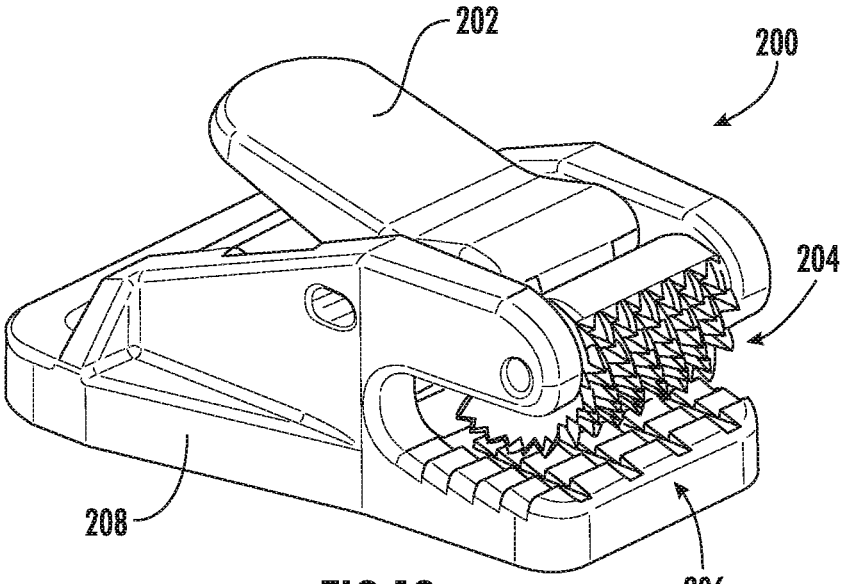
FIG. 18 is a perspective view of the hard hat lanyard clip of FIG. 16, according to an exemplary embodiment.

Referring to FIGS. 16-18, a clip 200 is shown according to an exemplary embodiment. Clip 200 is substantially the same as clip 52 except for the differences discussed herein. Similar to clip 52, clip 200 includes a lever 202, and a spring (like spring 88) is used to apply the gripping force between the rotating grip teeth 204 and the body teeth 206. Lever 202 is attached to the body 208 via arms that are inserted into a slot. Lever 202 is attached to the rotating teeth 204 via a connecting pin located through opening 212 that allows lever 202 and rotating teeth 204 to rotate with respect to one another. Rotating teeth 204 are attached to body 208 via the pivot (e.g., a pin) that passes through opening 210.

The spring applies a force between the spring seat structure to push lever 202 away from the body. As a result, the spring force is translated into a compressive force between the rotating teeth 204 and the body teeth 206. The tips of rotating teeth 204 are arranged along an arc or arcuate path (e.g., a spiral shape such as a logarithmic spiral, a circle) to allow various thicknesses of material to be inserted between the rotating and the body teeth and still have a sufficient gripping force between the two teeth. Also, many teeth are arranged staggered to one another such that the rotating teeth provide sufficient grip and engaging teeth in many rotational positions (e.g., depending on the thickness of material). Also, the sharpness of the teeth and the direction of the teeth are designed to sustain high pulling force for a variety of materials so that the design works well with various fabrics, including without limitation cotton, polyester, wool and spandex.

Figure 19:
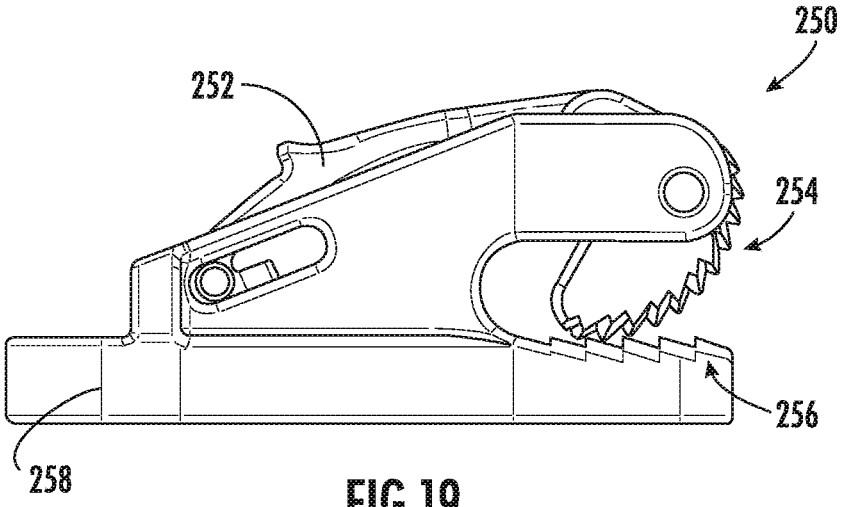
FIG. 19 is a side view of a hard hat lanyard clip, according to another exemplary embodiment.
Figure 20:
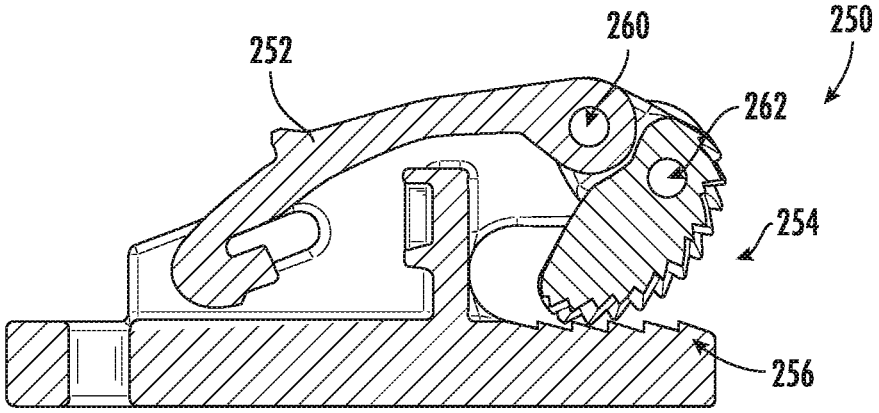
FIG. 20 is a sectional side view of the hard hat lanyard clip of FIG. 19, according to an exemplary embodiment.
Figure 21:
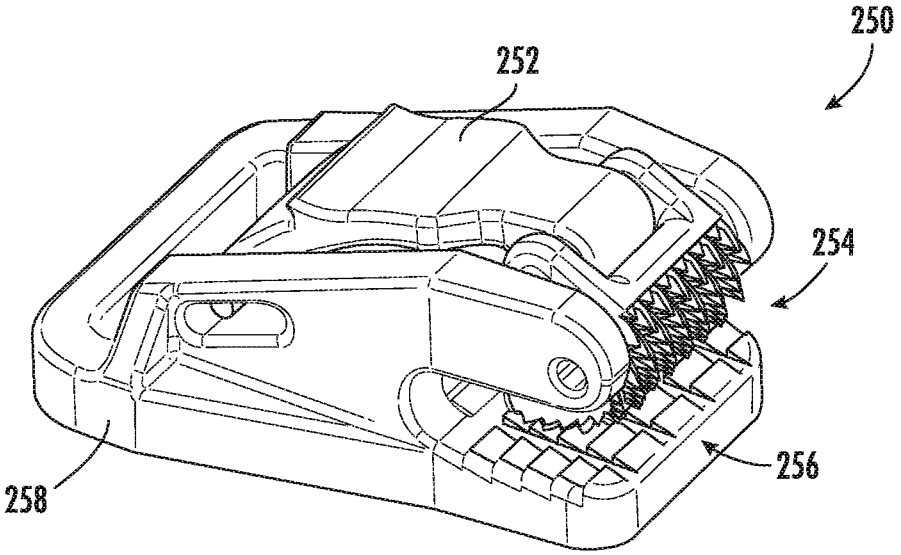
FIG. 21 is a perspective view of the hard hat lanyard clip of FIG. 19, according to an exemplary embodiment.

Referring to FIGS. 19-21, a clip 250 is shown according to an exemplary embodiment. Clip 250 is substantially the same as clip 52 except for the differences discussed herein. Clip 250 is a "slide" type clip and functions similarly to the "lever" design of clips 52 and 200 and has many of the same benefits. Slide 252 is connected to rotating teeth 254 via a connecting pin located through opening 260. Slide 252 is connected to body 258 via arms that ride in the slot of body 258. Rotating teeth 254 are connected to body 258 via a pin that passes through the pivot opening 262. Rotating teeth 254 are arranged on a spiral shape such that as the rotating teeth rotate about the pivot. In this arrangement, the distance between the body teeth and the rotating teeth varies, thereby accommodating multiple thicknesses of material. A spring (like spring 88) presses against slide 252 and body 258 to move slide 252 in the backward direction (as shown in FIG. 19). Moving slide 252 in the backward direction rotates rotating teeth 254 counterclockwise (in the orientation of FIGS. 19-21), thereby reducing the distance between rotating teeth 254 and body teeth 256 and applying a compressive force on a material between the opposing sets of teeth. A user can overcome the spring and press the slide in the forward direction to "open" the teeth to facilitate insertion or removal of the user's clothes between the teeth.

Figure 22:
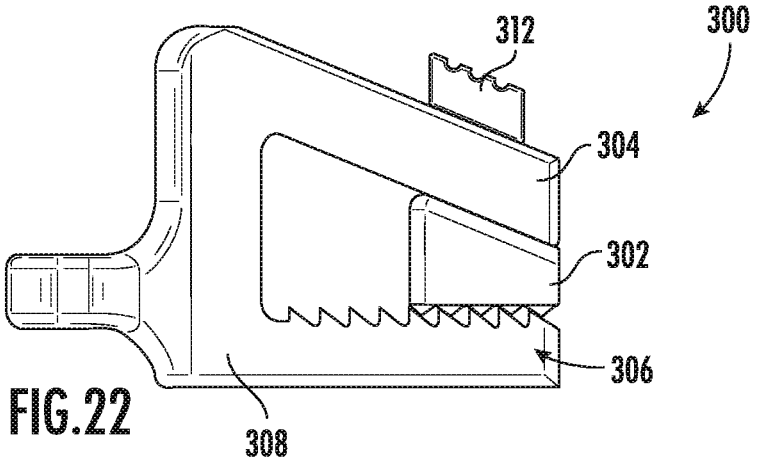
FIG. 22 is a side view of a hard hat lanyard clip, according to another exemplary embodiment.
Figure 23:
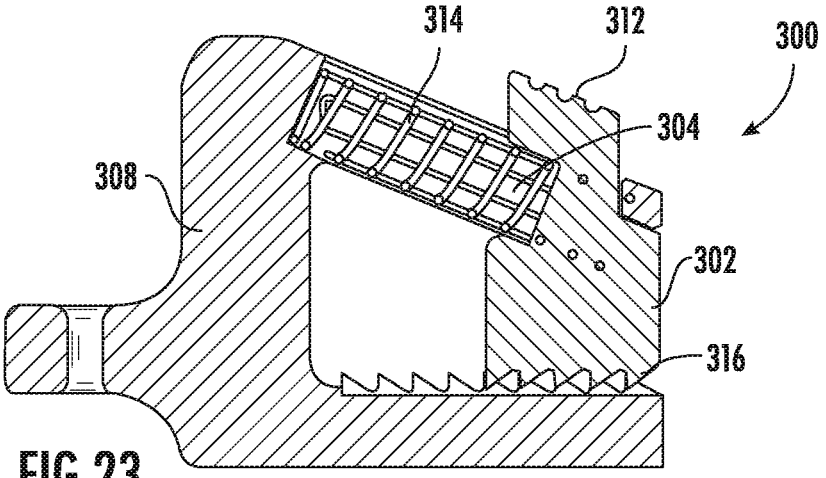
FIG. 23 is a sectional side view of the hard hat lanyard clip of FIG. 22, according to an exemplary embodiment.
Figure 24:
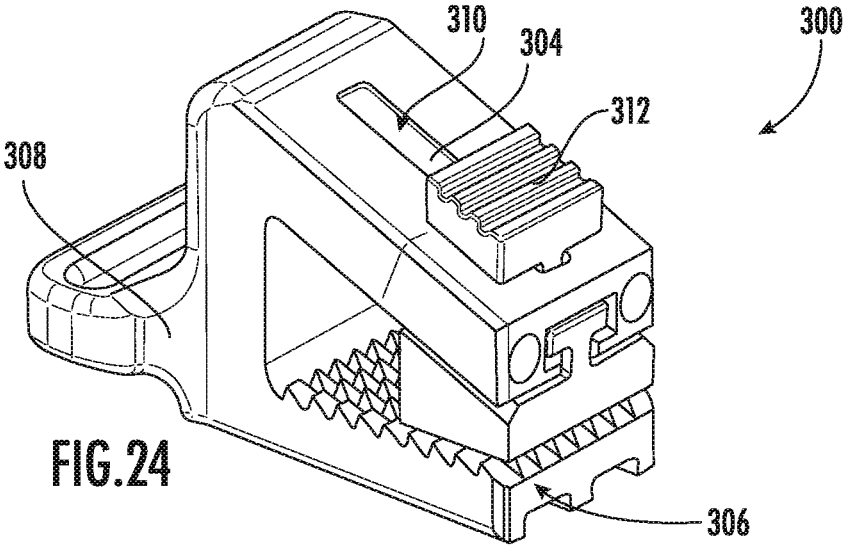
FIG. 24 is a perspective view of the hard hat lanyard clip of FIG. 22, according to an exemplary embodiment.
Figure 25:
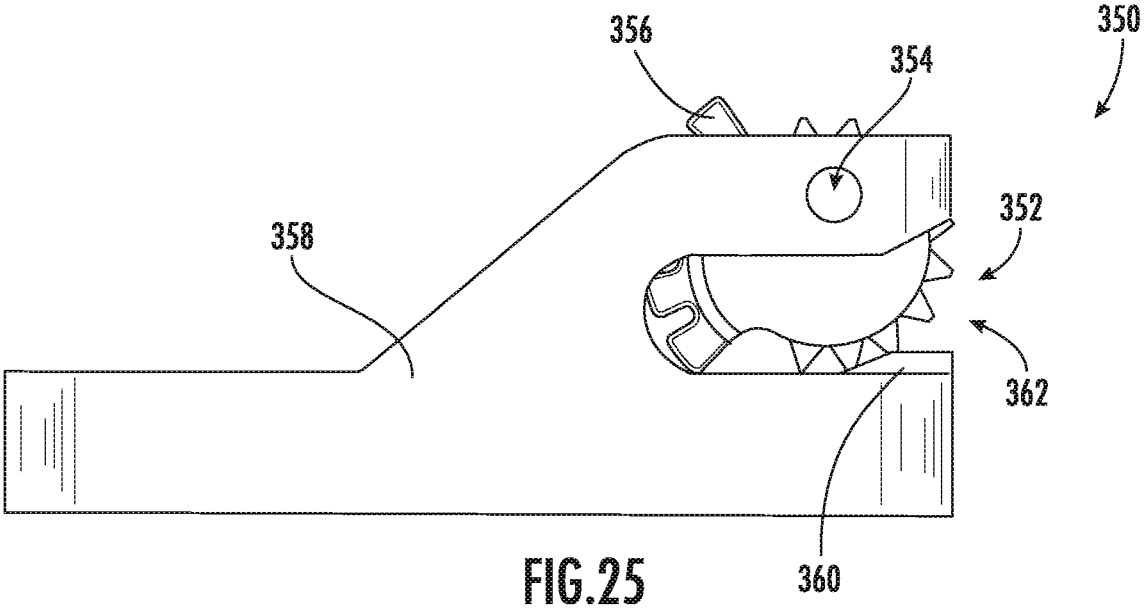
FIG. 25 is a side view of a hard hat lanyard clip, according to another exemplary embodiment.
Figure 26:
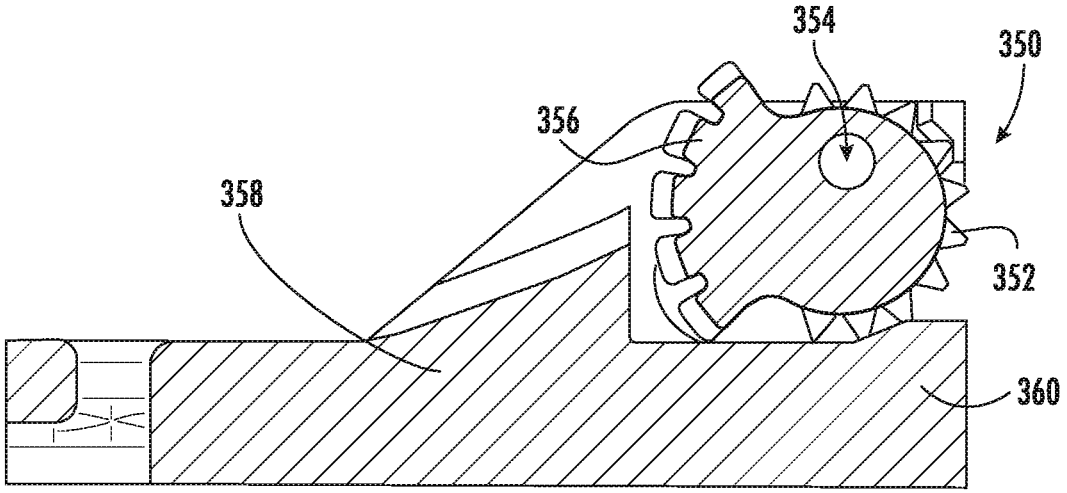
FIG. 26 is a sectional side view of the hard hat lanyard clip of FIG. 25, according to an exemplary embodiment.
Figure 27:
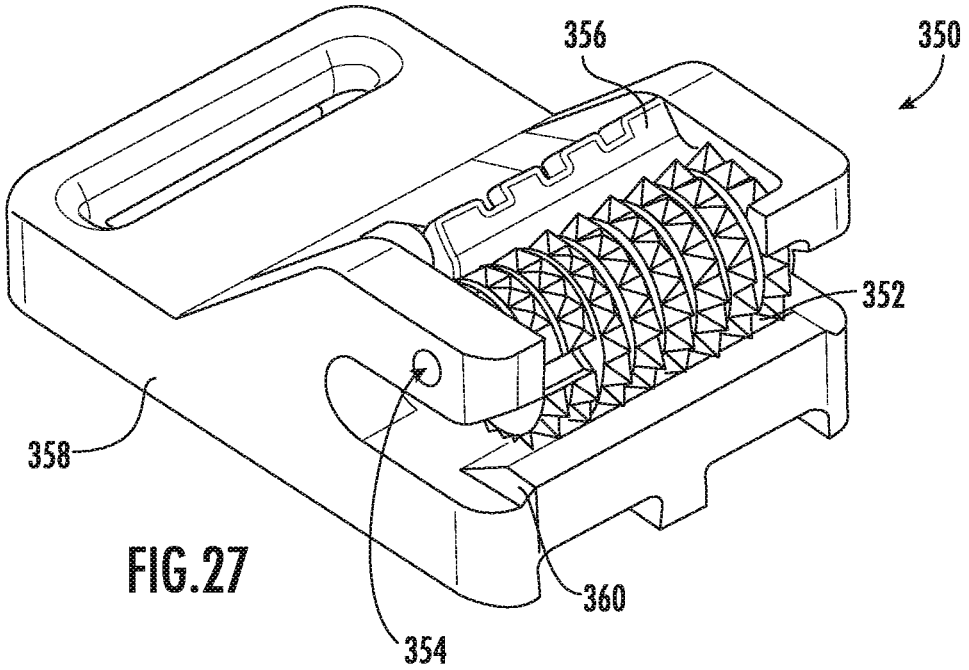
FIG. 27 is a front perspective view of the hard hat lanyard clip of FIG. 25, according to an exemplary embodiment.
Figure 28:
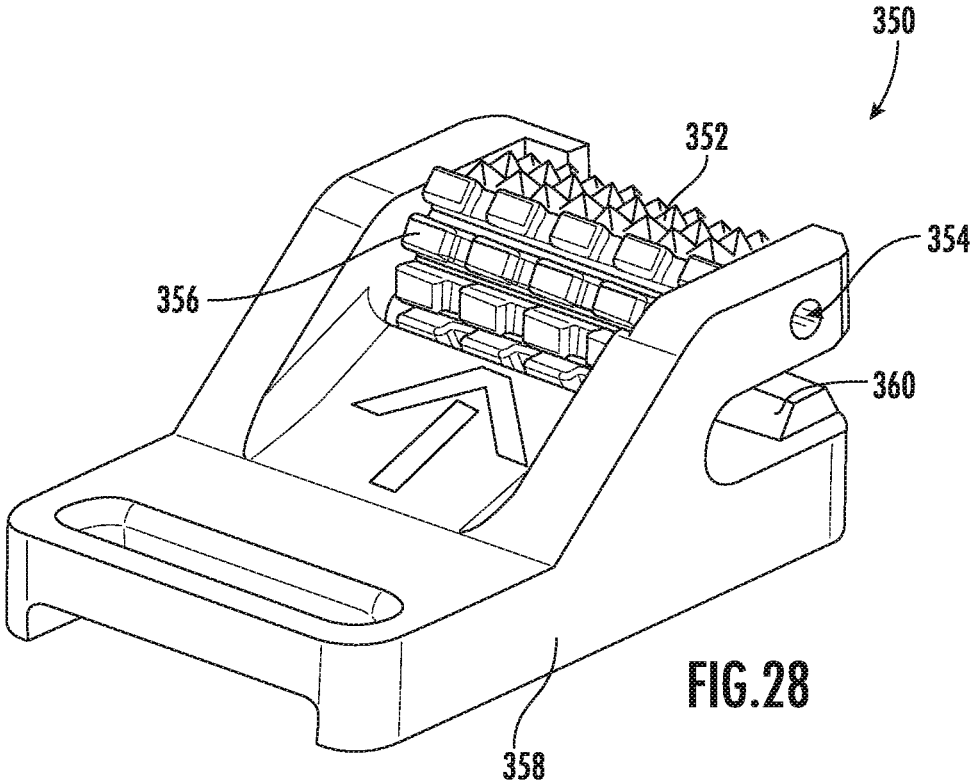
FIG. 28 is a rear perspective view of the hard hat lanyard clip of FIG. 25, according to an exemplary embodiment.

Referring to FIGS. 22-24, a clip 300 is shown according to an exemplary embodiment. Clip 300 is substantially the same as clips 52 and 250 except for the differences discussed herein. Clip 300 is an embodiment of a "slide jaw" type clip that has an upper tooth block 302 that slides along a ramp 304 to adjust a distance between upper tooth block 302 and lower teeth 306 and, therefore, accommodate multiple thicknesses of material. Body 308 includes a slot 310 through which a button 312 of upper tooth block 302 extends. A spring 314 applies a force that presses upper tooth block 302 along ramp 304 towards a "closed" position. Thus, spring 314 applies a compressive force between the upper teeth 316 and lower teeth 306.

Referring to FIGS. 25-28, a clip 350 is shown according to an exemplary embodiment. Clip 350 is substantially the same as clips 52 and 300 except for the differences discussed herein. Clip 350 is a "thumb roller" design and has only a few components. Rotating teeth 352 rotate about the pivot (e.g., via a through-pin) that extends through opening 354. The user can rotate rotating teeth 352 into an "open position" by rotating thumb grips 356. Opening 354 and the related pivot is off-center from rotating teeth 352 to provide a cam that allows variation of the distance between the rotating teeth and the body during operation of clip 350. Body 358 includes a ramp 360 near opening 362 of the C-shape of body 358 that provides for the increase in gripping forces if material within clip 350 is pulled out without manually opening the clip. For example, as material is pulled out of the C-shape opening defined between teeth 352 and ramp 360, the material is pressed up against rotating teeth 352 by the body ramp 360, thereby increasing the gripping force. Similarly, as the material is pulled out, rotating teeth 352 are rotated in a direction that closes the opening, thereby increasing the grip between the teeth 352 and the body ramp 360. In some embodiments, a torsion spring can be provided to bias the rotating teeth in a counter-clockwise direction (from the perspective shown above).

It should be understood that the figures illustrate the exemplary embodiments in detail, and it should be understood that the present application is not limited to the details or methodology set forth in the description or illustrated in the figures. It should also be understood that the terminology is for description purposes only and should not be regarded as limiting.

Further modifications and alternative embodiments of various aspects of the invention will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is in no way intended that any particular order be inferred. In addition, as used herein, the article "a" is intended to include one or more component or element, and is not intended to be construed as meaning only one. As used herein, "rigidly coupled" refers to two components being coupled in a manner such that the components move together in a fixed positional relationship when acted upon by a force.

Various embodiments of the invention relate to any combination of any of the features, and any such combination of features may be claimed in this or future applications. Any of the features, elements or components of any of the exemplary embodiments discussed above may be utilized alone or in combination with any of the features, elements or components of any of the other embodiments discussed above.

What is claimed is:

1. A lanyard clip comprising:

a body;

a lever pivotally coupled to the body such that the lever pivots with respect to the body about a first axis;

a grip pivotally coupled to the lever and the grip pivots with respect to the lever about a second axis, wherein the grip is also pivotally coupled to the body and the grip pivots with respect to the body about a third axis, wherein the first axis, the second axis, and the third axis are spaced apart from each other;

a first plurality of teeth extending from the grip towards the body; and a second plurality of teeth extending from the body towards the grip, wherein the grip is moveable about the second and third axes between an open position and a clamped position, wherein, in the clamped position, the second plurality of teeth interface against the first plurality of teeth.

2. The lanyard clip of claim 1, wherein the second axis is closer than the third axis to the second plurality of teeth when the grip is in the clamped position.

3. The lanyard clip of claim 1, wherein each of the first plurality of teeth includes a tip, wherein the first plurality of teeth extend from the grip in an orientation such that the tips of the first plurality of teeth lie on an arcuate path.

4. The lanyard clip of claim 3, wherein each of the second plurality of teeth includes a tip, wherein the second plurality of teeth extend from the body in an orientation such that the tips of the second plurality of teeth lie in a generally horizontal plane.

5. The lanyard clip of claim 1, further comprising a biasing element located between the body and the lever, wherein the biasing element biases the grip toward the clamped position.

6. The lanyard clip of claim 5, wherein the body defines a length direction extending from a lanyard end of the body to a clamping end of the body, and further wherein the first axis is located between the biasing element and the second axis in the length direction and the second axis is located between the first axis and the third axis in the length direction.

7. The lanyard clip of claim 6, wherein the second axis and the third axis are located above the second plurality of teeth in a height direction.

8. The lanyard clip of claim 7, further comprising a lanyard coupled to a lanyard end of the body.

9. A lanyard clip comprising:

a body;

a grip pivotally coupled to the body;

a first plurality of teeth, wherein the first plurality of teeth extend from the grip towards the body, wherein each of the first plurality of teeth includes a tip, wherein the first plurality of teeth extend from the grip in an orientation such that the tips of the first plurality of teeth lie on an arcuate path; and a second plurality of teeth extending from the body towards the first plurality of teeth, wherein the second plurality of teeth interface against the first plurality of teeth when the lanyard clip is in a closed position, and wherein the arcuate path of the tips of the first plurality of teeth is convex with respect to the second plurality of teeth.

10. The lanyard clip of claim 9, wherein each of the second plurality of teeth includes a tip, wherein the second plurality of teeth extend from the body in an orientation such that the tips of the second plurality of teeth lie in a generally horizontal plane.

11. The lanyard clip of claim 9, further comprising a lever pivotally coupled to the body such that the lever pivots with respect to the body about a first axis, wherein the grip is pivotally coupled to the lever about a second axis, wherein the grip pivots with respect to the body about a third axis, wherein the first axis, the second axis, and the third axis are spaced apart from each other and are parallel to each other.

12. The lanyard clip of claim 11, wherein the second axis is closer than the third axis to the second plurality of teeth when the grip is in the closed position.

13. The lanyard clip of claim 11, further comprising a biasing element located between the body and the lever, wherein the biasing element biases the grip toward the closed position.

14. The lanyard clip of claim 13, wherein the body defines a length direction extending from a lanyard end of the body to a clamping end of the body, and further wherein the first axis is located between the biasing element and the second axis in the length direction and the second axis is located between the first axis and the third axis in the length direction.

15. The lanyard clip of claim 14, wherein the second axis and the third axis are located above the second plurality of teeth in a height direction, which is perpendicular to the length direction.

16. A lanyard clip comprising:

a body;

a lever pivotally coupled to the body such that the lever pivots with respect to the body about a first axis;

a grip pivotally coupled to the lever about a second axis;

a first plurality of teeth extending from the grip towards the body; and a second plurality of teeth extending from the body towards the grip, wherein the grip is moveable relative to the body between an open position and a clamped position, wherein, in the clamped position, the second plurality of teeth interface against the first plurality of teeth;

wherein the first plurality of teeth have a tooth depth between 0.12 inches and 0.18 inches;

wherein the second plurality of teeth have a tooth depth between 0.12 inches and 0.18 inches;

wherein the grip pivots with respect to the body about a third axis; and wherein the first axis, the second axis, and the third axis are spaced apart from each other and are parallel to each other.

17. The lanyard clip of claim 16, wherein each of the first plurality of teeth includes a tip, wherein the first plurality of teeth extend from the grip in an orientation such that the tips of the first plurality of teeth lie on an arcuate path.

18. The lanyard clip of claim 17, wherein each of the second plurality of teeth includes a tip, wherein the second plurality of teeth extend from the body in an orientation such that the tips of the second plurality of teeth lie in a generally horizontal plane.

19. The lanyard clip of claim 16, wherein the second axis is closer than the third axis to the second plurality of teeth when the grip is in a closed position.

* * * * *